US010845042B1

(12) United States Patent
Shellman

(10) Patent No.: US 10,845,042 B1
(45) Date of Patent: Nov. 24, 2020

(54) PORTABLE LIGHTING SYSTEM

(71) Applicant: Craig Shellman, Elk Grove Village, IL (US)

(72) Inventor: Craig Shellman, Elk Grove Village, IL (US)

( * ) Notice: Subject to any disclaimer, the term of this patent is extended or adjusted under 35 U.S.C. 154(b) by 0 days.

(21) Appl. No.: 16/782,272

(22) Filed: Feb. 5, 2020

(51) Int. Cl.

| | |
|---|---|
| ***F21V 21/00*** | (2006.01) |
| ***F21V 21/30*** | (2006.01) |
| ***F21L 4/00*** | (2006.01) |
| ***F21V 23/00*** | (2015.01) |
| ***F21V 1/14*** | (2006.01) |
| ***F21V 1/08*** | (2006.01) |
| ***A45B 19/10*** | (2006.01) |
| ***F21V 1/06*** | (2006.01) |
| ***F21V 21/14*** | (2006.01) |
| *F21Y 115/10* | (2016.01) |
| *F21W 131/402* | (2006.01) |
| *A63J 1/02* | (2006.01) |

(52) U.S. Cl.
CPC ..... *F21V 21/30* (2013.01); *A45B 19/10* (2013.01); *F21L 4/00* (2013.01); *F21V 1/06* (2013.01); *F21V 1/08* (2013.01); *F21V 1/14* (2013.01); *F21V 21/14* (2013.01); *F21V 23/001* (2013.01); *A63J 2001/024* (2013.01); *F21W 2131/402* (2013.01); *F21Y 2115/10* (2016.08)

(58) Field of Classification Search
CPC ... F21V 21/30; F21V 1/06; F21V 1/08; F21V 1/14; F21V 23/001; F21V 21/14; F21L 4/00; F21Y 2115/10; F21W 2131/402; A45B 19/10; A63J 2001/024
USPC ..... 362/352, 355, 358, 278; 428/9, 11, 12, 428/27
See application file for complete search history.

(56) References Cited

U.S. PATENT DOCUMENTS

| | | | | | |
|---|---|---|---|---|---|
| 3,162,377 | A | * | 12/1964 | Ozeki | F21V 1/06 362/320 |
| 4,834,033 | A | * | 5/1989 | Larsen | F01B 3/045 123/56.8 |
| 5,629,057 | A | * | 5/1997 | Wang | B44C 5/00 362/122 |
| 5,776,578 | A | * | 7/1998 | Dejaynes | D04D 7/04 428/12 |
| 5,791,773 | A | * | 8/1998 | Babineaux | F21V 1/06 362/16 |

(Continued)

*Primary Examiner* — Laura K Tso
(74) *Attorney, Agent, or Firm* — Bishop, Diehl & Lee, Ltd.

(57) ABSTRACT

A portable lighting system for single-handed operation includes abase for supporting the portable lighting system, a light source positioned on the base, a traveler having a key member attached to a rotating shaft mechanism extending from the traveler, and a frame connected to the base and the traveler and enclosing the light source. The frame includes a plurality of flexible ribs attached to the base at a first end and to the traveler at a second end, a latch plate having a key opening for engaging the key member and spaced a distance from the traveler, and at least one guide track connected between the traveler and the latch plate. The traveler is movable along the guide member from a starting position toward the latch plate causing the flexible ribs to bend outwardly and the key member is configured to enter the key opening and rotate via the rotating shaft mechanism to lock the traveler from returning to the starting position on the guide track. This configures the lighting system for use.

12 Claims, 14 Drawing Sheets

(56) References Cited

U.S. PATENT DOCUMENTS

| | | | | |
|---|---|---|---|---|
| 5,916,326 | A * | 6/1999 | Tischer | F16H 61/30 74/335 |
| 6,284,330 | B1 * | 9/2001 | Hermanson | A47G 33/06 362/806 |
| 6,474,843 | B2 * | 11/2002 | Shieh | B44C 5/00 362/227 |
| 6,769,793 | B2 * | 8/2004 | Hornsby | F21V 3/023 362/352 |
| 8,192,044 | B2 * | 6/2012 | Allsop | F21V 3/023 362/183 |
| 8,197,917 | B2 * | 6/2012 | Wang | A47G 33/08 428/8 |
| 9,410,693 | B2 * | 8/2016 | Cohen | F21V 33/0028 |
| 9,631,800 | B2 * | 4/2017 | Coughlin | F21V 21/14 |
| 10,161,582 | B1 * | 12/2018 | Qiu | F21V 21/0832 |
| 2006/0279956 | A1 * | 12/2006 | Richmond | F21V 15/01 362/374 |
| 2007/0236943 | A1 * | 10/2007 | Lee | F21V 1/06 362/355 |
| 2010/0097812 | A1 * | 4/2010 | Cheng | F21S 4/10 362/382 |

* cited by examiner

PORTABLE LIGHTING SYSTEM

TECHNICAL FIELD OF THE INVENTION

The present invention relates to portable lighting systems. More specifically, the invention relates to a portable lighting system which is easily assembled for use.

BACKGROUND OF THE INVENTION

Providing proper lighting for an evening event is one of the more difficult tasks in planning. Where safety is a factor, the need to provide proper lighting is greatly heightened. Such is exactly the situation along roadsides where construction crews, construction equipment and potentially hazardous conditions exist. Not just lighting, but proper lighting is crucial to a safe working environment.

Each state has operational requirements for lighting these roadside work zones, with instructions as to area to be illuminated, direction of lighting, height of lights, and even the output (e.g., lumens) of the light source. However, compliance with these requirements can be difficult for road crews. Lights and all the accompanying stands, cords, generators, etc. can be difficult to set-up, take down, and move, especially for a constantly moving work force on a roadside.

One common light used by road crews is the balloon light. This type of light typically consists of an orange and white colored cover over a globe-like frame housing a high-powered light source. The globe-like frame provides protection for the expensive light within. The cover is used for added protection, to create contrast (orange and white) for improved visibility and to prevent glare for motorist. The light structure must be sturdy to withstand various weather conditions, as well as air turbulence created by moving vehicles, and yet must be readily moved to accommodate the ever-changing dynamics of a roadside construction site. Unfortunately, making a device sturdy and weather-resistant adds to the weight and complexity of the system.

The industry needs a lighting system which is portable, easy to set-up and take down, relatively easy to attach to roadside stands and construction vehicles, and durable against numerous weather conditions and turbulent airflow from traffic.

Until the invention of the present application, these and other problems in the prior art went either unnoticed or unsolved by those skilled in the art. The present invention provides a portable lighting system which performs multiple functions without sacrificing portability, illumination, durability or affordability.

SUMMARY OF THE INVENTION

There is disclosed herein an improved lighting system and assembly which avoids the disadvantages of prior devices and systems while affording additional structural and operating advantages.

Generally speaking, the disclosure is directed to a portable lighting system comprising a base for supporting the portable lighting system, a light source positioned on the base, a traveler having a key member attached to a rotating shaft mechanism extending from the traveler, and a frame connected to the base and the traveler and enclosing the light source. In a preferred embodiment, the frame comprises a plurality of flexible ribs attached to the base at a first end and to the traveler at a second end, a latch plate having a key opening for engaging the key member and spaced a distance from the traveler, and at least one guide track connected between the traveler and the latch plate.

In the preferred embodiment, the traveler is movable along the guide member from a starting position toward the latch plate causing the flexible ribs to bend outwardly and the key member is configured to enter the key opening and rotate via the rotating shaft mechanism to lock the traveler from returning to the starting position on the guide track. This configures the lighting system for use.

In specific embodiments, the rotating shaft mechanism is configured to rotate the key member in the range of 10 to 170 degrees when the traveler reaches a first point along the guide track, then 170 to 10 degrees at a second point along the guide track. More preferably, in specific embodiments, the rotating shaft mechanism is configured to rotate the key member in the range of 60 to 120 degrees at the first point and 120 to 60 degrees at the second point.

In other specific embodiments, a cover is attachable to the flexible ribs to enclose the light source. The cover may be colored (e.g., orange and white) to increase visibility.

In specific embodiments described, the light source comprises an LED bulb having a watt equivalence in the range of 300 to 1500 watts.

In specific embodiments, the portable lighting system is mountable on a vehicle using a bracket attached to the base. Alternatively or additionally, the lighting system may mount to a roadway stand.

The present disclosure is also directed to a rotating shaft mechanism for allowing single-handed expansion of a portable light system. Generally speaking, the rotating shaft mechanism comprises a cylinder having one end capable of being fixed to a structure, a rotatable shaft positioned and movable within the cylinder, a slider transversely fixed to the rotatable shaft, a first slider guide track fixed to the cylinder at a position to engage a first side of the slider, and a second slider guide track fixed to the cylinder at a position to engage a second side of the slider opposite the first side. In a preferred embodiment, the slider engages the first track when the rotatable shaft moves longitudinally in a first direction within the shaft and the slider engages the second track when the rotatable shaft moves longitudinally in a second direction within the shaft, the second direction being opposite the first direction, and the shaft rotates as it moves in the first and second directions as a result of the slider engaging the first and second tracks.

In specific embodiments, the shaft alternately moves in the first and second direction to rotate 360 degrees. The shaft rotates in the range of 10 to 80 degrees when the slider engages the first track as the shaft moves in the first direction and the shaft rotates another 80 to 10 degrees when the slider engages the second track as the shaft moves in the second direction.

More preferably, the shaft rotates in the range of 30 to 60 degrees when the slider engages the first track as the shaft moves in the first direction, and the shaft rotates another 60 to 30 degrees when the slider engages the second track as the shaft moves in the second direction.

These and other aspects of the invention may be understood more readily from the following description and the appended drawings.

BRIEF DESCRIPTION OF THE DRAWINGS

For the purpose of facilitating an understanding of the subject matter sought to be protected, they are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
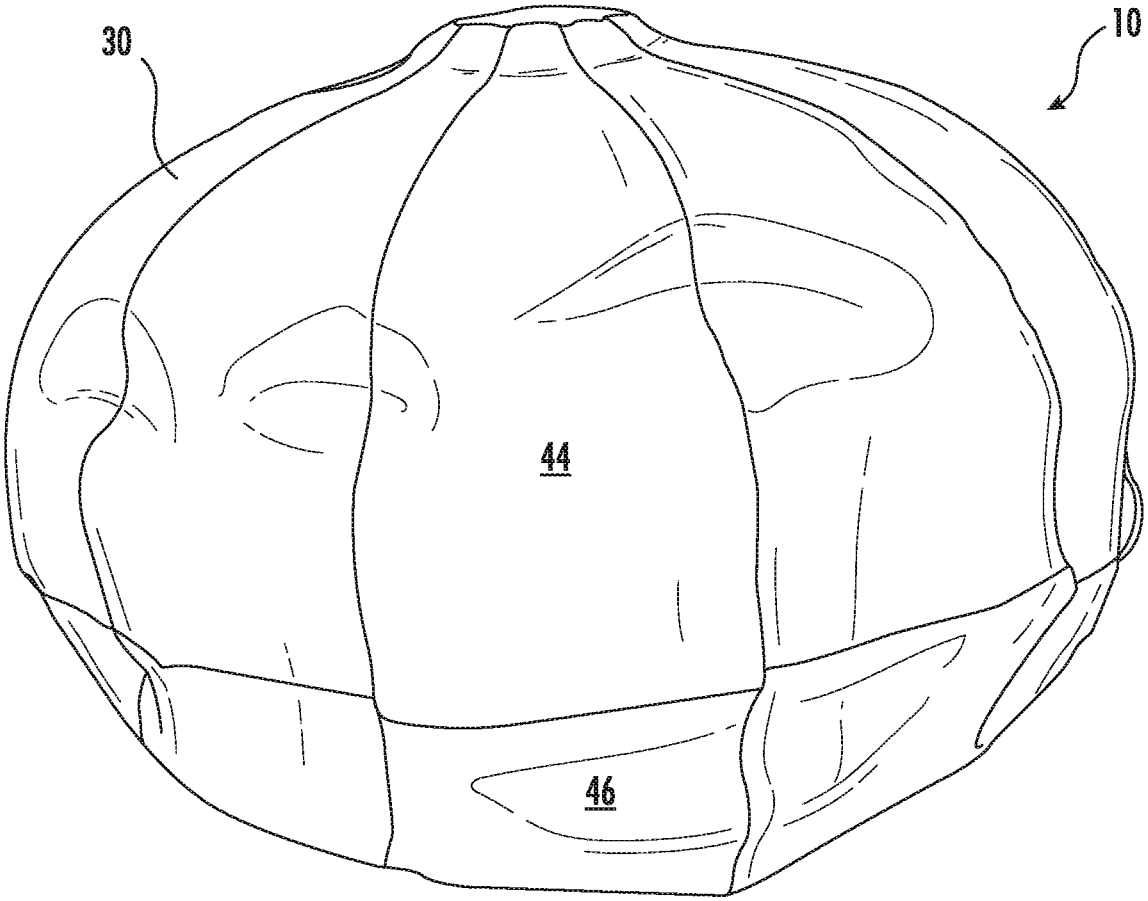
FIG. 1 is a front view of an embodiment of the erected lighting system of the present disclosure.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-17, there is illustrated at least one embodiment of a portable lighting system, generally designated by the numeral 10, and its numerous components. The particular illustrated lighting system 10 was originally developed for roadside and construction sites. However, while all the embodiments illustrated and the following descriptions are directed to a roadside lighting system, it should be understood that the principles of the invention can be more broadly applied to a portable lighting system for many other purposes.

Figure 2:
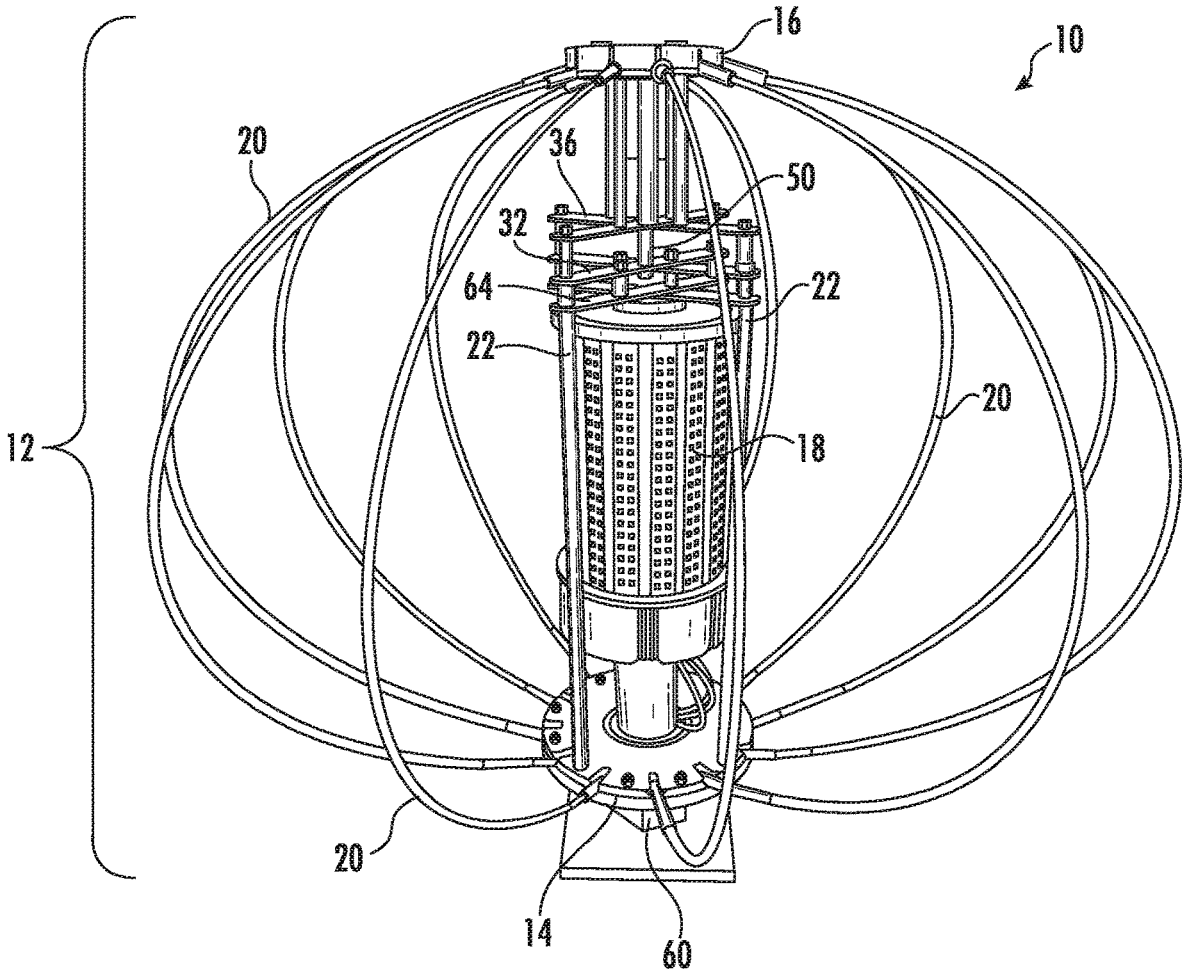
FIG. 2 is a perspective view of an embodiment of the erected lighting system shown in FIG. 1 without the exterior cover.
Figure 3:
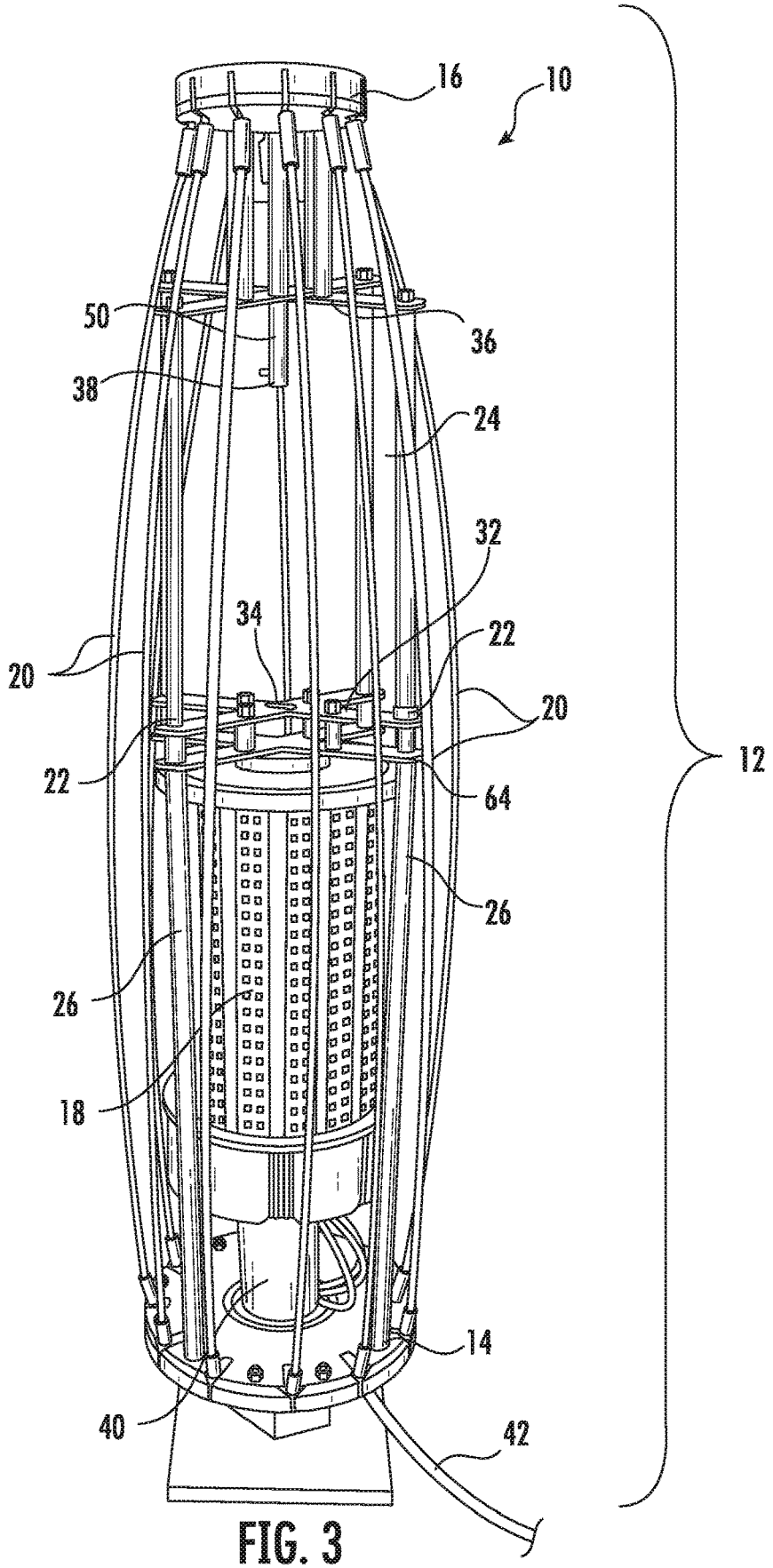
FIG. 3 is a perspective view of the lighting system embodiment of FIG. 2 in a collapsed condition.

As can be seen in FIGS. 1-3, the lighting system 10 consists of a frame 12 with a base 14 positioned at a lower end and a traveler 16 positioned at an upper end, and a light source 18 positioned within the frame 12 and between the base 14 and traveler 16. The frame 12 includes both flexible ribs 20, which are attached to the base 14 and the traveler 16, and fixed guide rails 22, which are also attached by one end to the base 14 and an opposite end to the traveler 16. The guide rails 22, of which there are preferably four, are designed to telescope such that as the traveler 16 moves up and down an inner rod 24 slides within an outer tube 26 to expand and contract the guide rails 22. The outer tubes 26 are spring-actuated (not shown) by the flexible ribs (20) such that the inner rods 24 are biased out (see FIG. 3).

The flexible ribs 20, as shown best in FIG. 2, bow outward when the traveler 16 moves downward to create a globe-shape. Each of the flexible ribs 20, of which there are preferably twelve (12), are equally spaced about the periphery of the base 14 and traveler 16 and are pivotably attached to both (see FIGS. 15 and 16). The entire system 10 is enclosed by a cover 30 (see FIG. 1) which helps diffuse light and protects the light source 18 and mechanical structures from the elements.

As shown in FIG. 3, a latch plate 32 having an opening 34 is fixed to each of the upper ends of the outer tubes 26 of the guide rails 22. A similar key plate 36 is attached to each upper end of the inner rods 24 of the guide rails 22 such that a key member 38, which radially extends from a rotating shaft mechanism 50 attached to the key plate 36, aligns with the opening 34.

Figure 4:
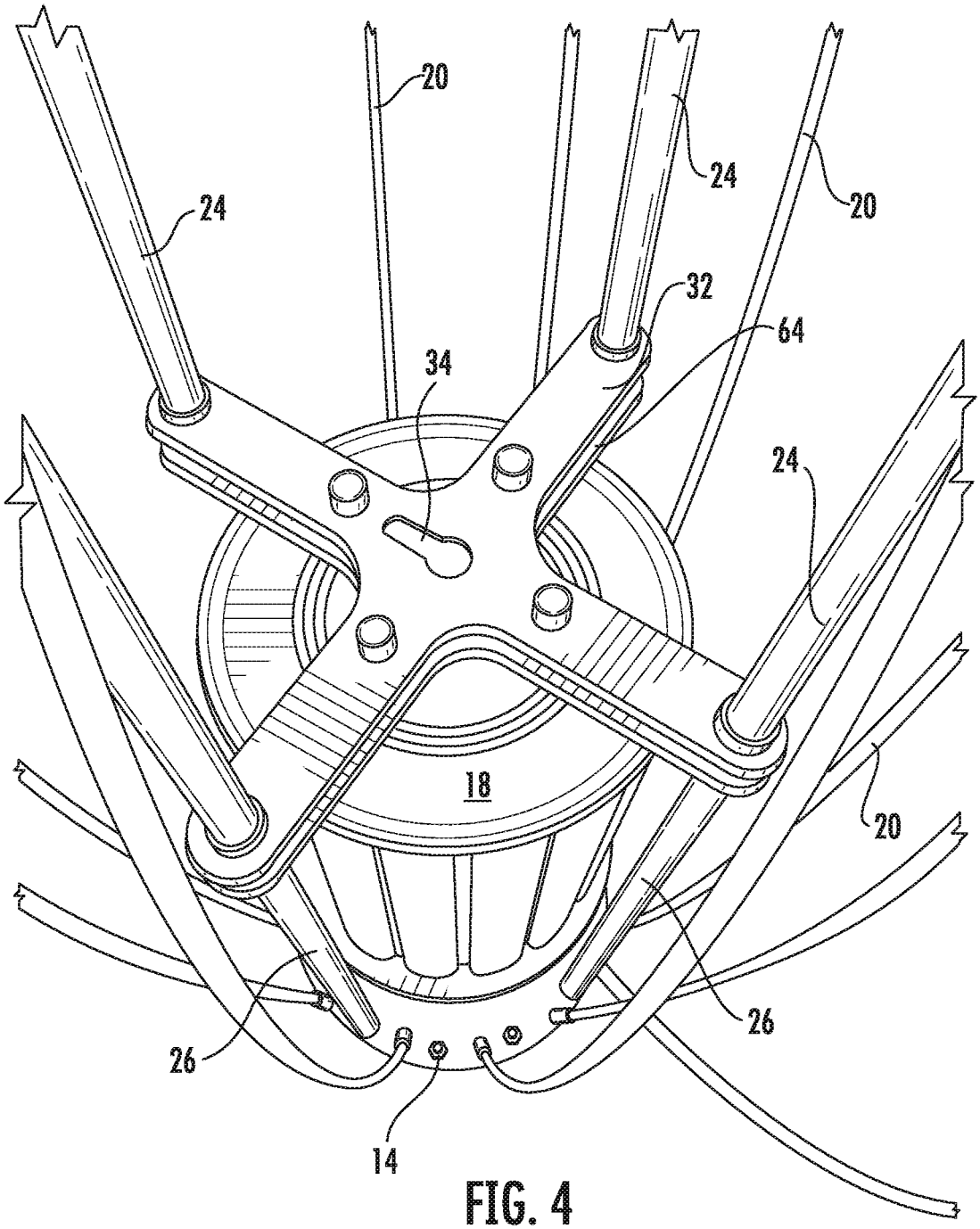
FIG. 4 is a close-up view of an embodiment of a latch plate in accordance with the present disclosure.
Figure 17:
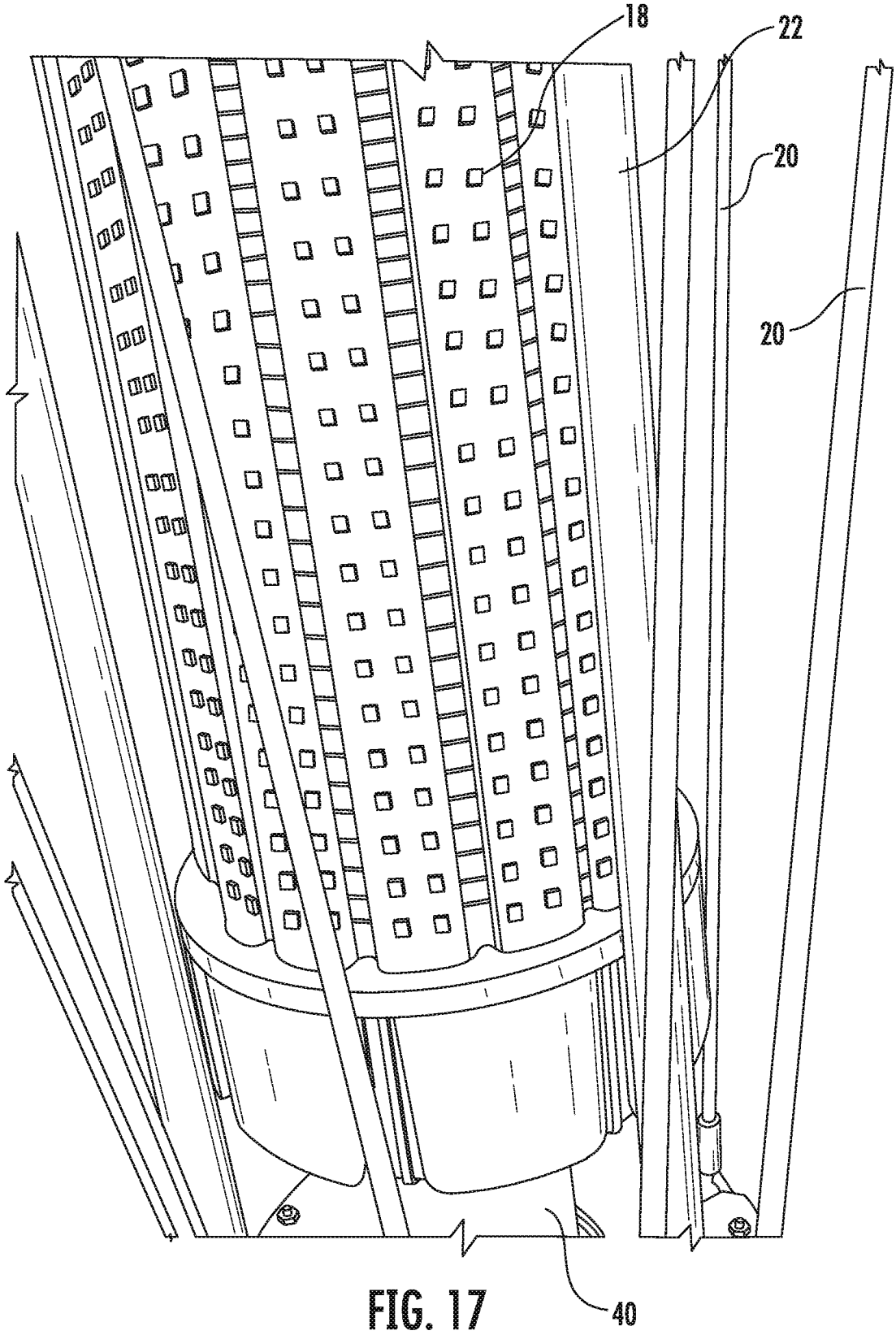
FIG. 17 is a side view of an embodiment of the light source used for the disclose lighting system.

As shown in FIGS. 4 and 17, positioned within the frame 12 below the latch plate 32 is the light source 18. In a preferred embodiment, the light source 18 is a 240 W LED Corn Light Bulb (1500 W equivalent), manufactured and sold by EverWatt of Richmond, Calif. The bulb is a 360-degree LED bulb constructed with heavy-duty corrosion-resistant materials. The bulb may range in size from a 40 W to a 300 W LED (approximate range of 300 W to 2000 W equivalent), depending on the intended use. Within the base 14 of the lighting system 10 is a bulb socket 40 which connects to an AC power cord 42.

The cover 30 is preferably comprised of numerous panels joined together to allow proper expansion when the lighting system 10 is set-up. The cover 30 can be divided into a top section 44 and a bottom section 46. The top section 44 is preferably substantially opaque and comprised of a durable, water-resistant material (e.g., polyurethane laminate, Naugahyde™, PVC-coated polyester, or similar materials), while the bottom section 46 is sufficiently transparent to allow diffusion of light. The two sections, 44 and 46, are preferably of contrasting colors (e.g., orange and white) to increase visibility. Snaps, clips, hook-and-loop material, or other known means may be used along the bottom opening of the cover 30 to help secure it to the base 14 of the lighting system 10. Additional connectors, such as hook-and-loop strips, may be employed on the internal surface of the cover 30 to secure to the flexible ribs 20.

An attachment shaft 60 (FIG. 2) extends from the bottom of the base 14 to allow the lighting system 10 to be mounted to a stand (not shown) or a vehicle (not shown). Other means for attaching the lighting system 10 may be used, including permanent attachment.

Figure 5:
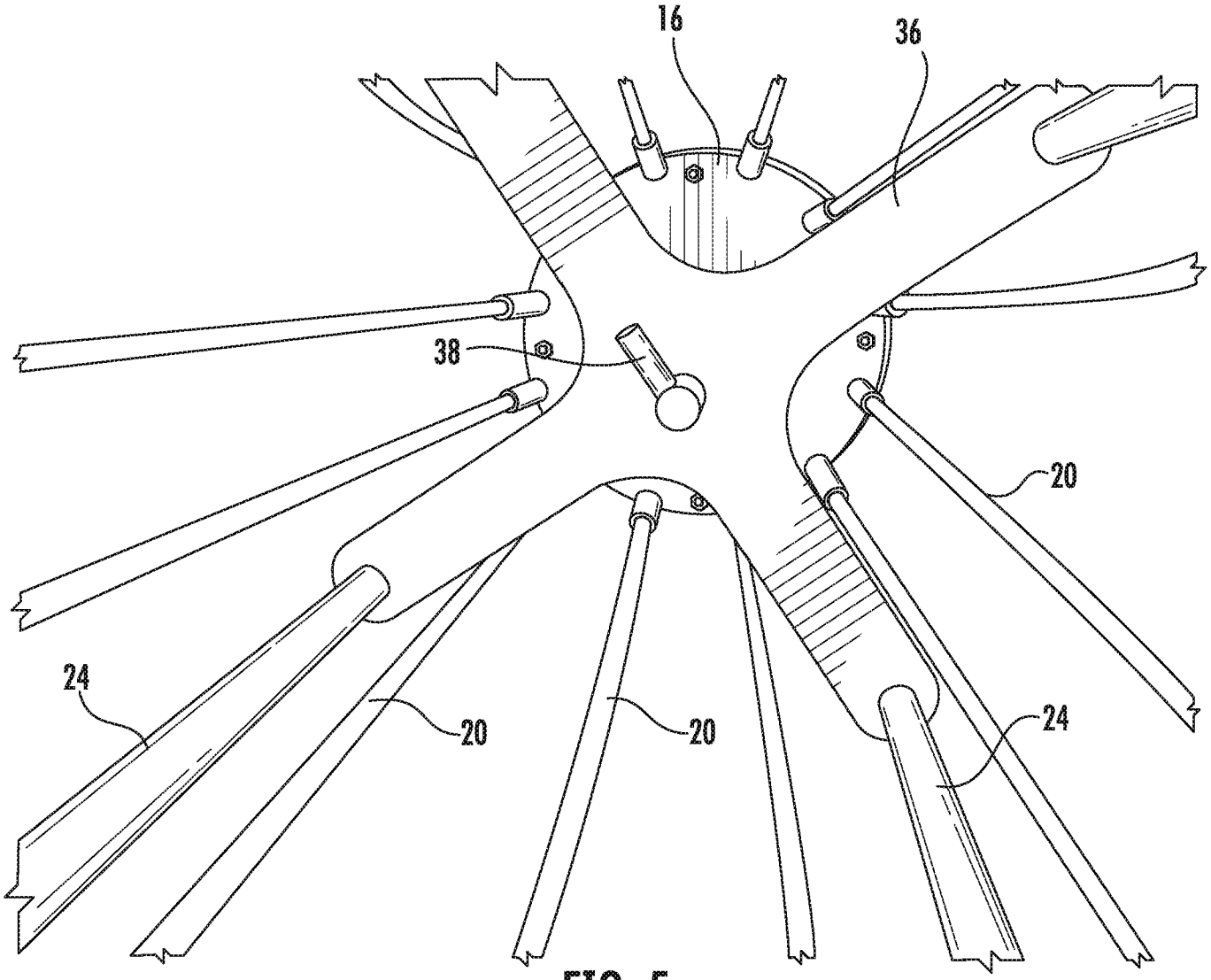
FIG. 5 is a close-up view of an embodiment of a key member on the underside of a traveler in accordance with the present disclosure.
Figure 6:
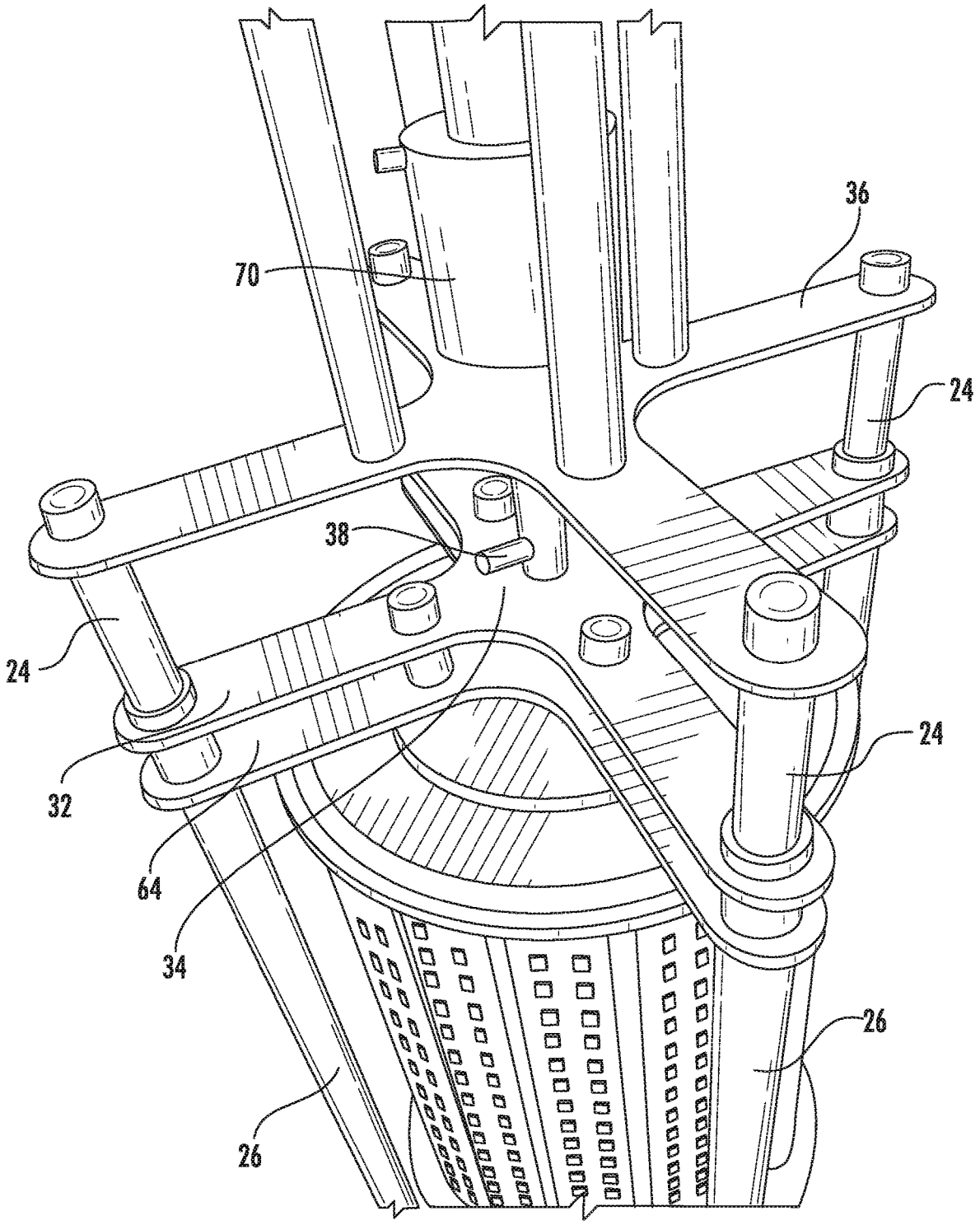
FIG. 6 is a close-up showing the key member about to enter the opening of the latch plate.
Figure 7:
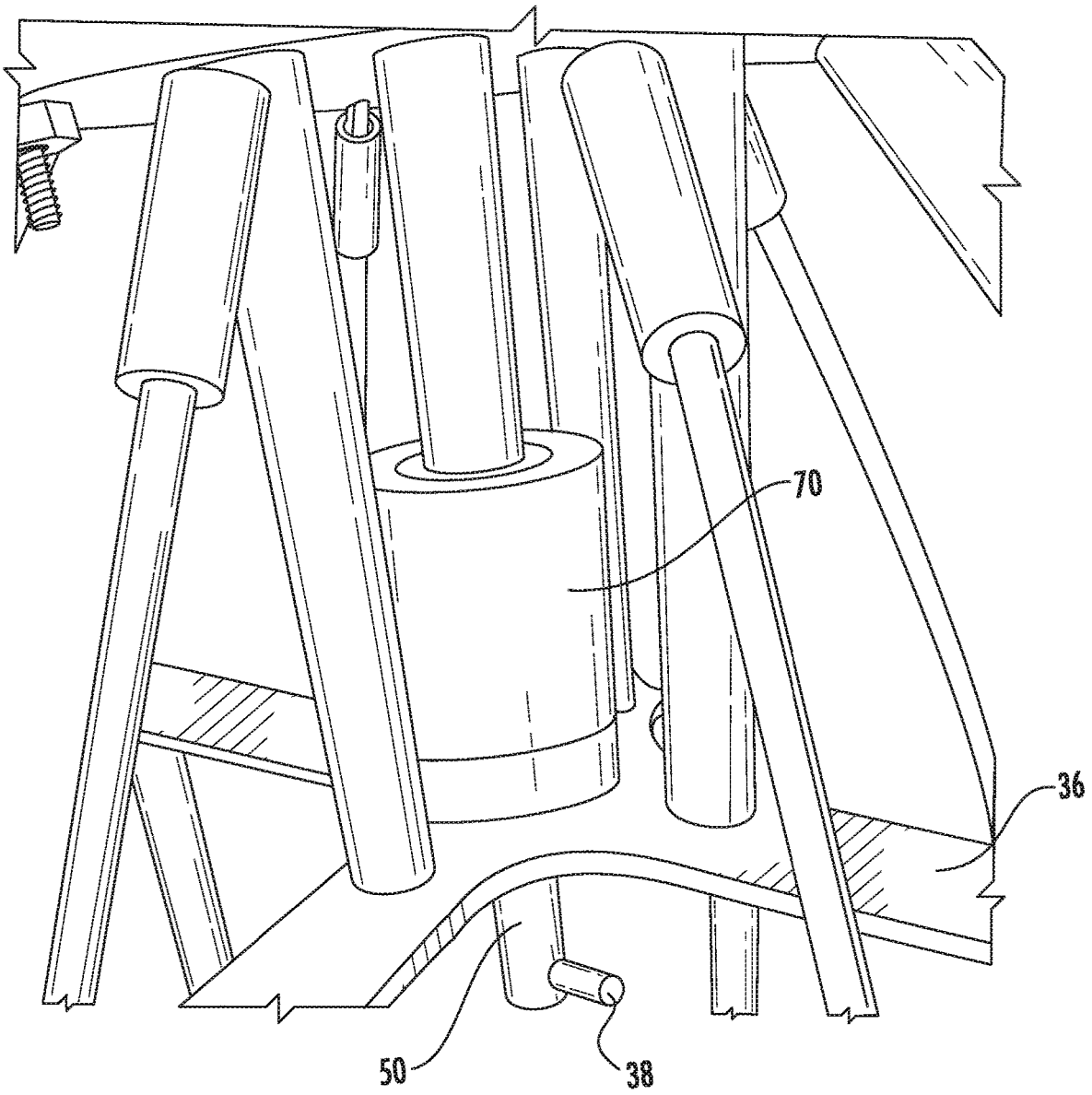
FIG. 7 is a close-up view of an embodiment of the shaft and key member on the traveler.
Figure 8:
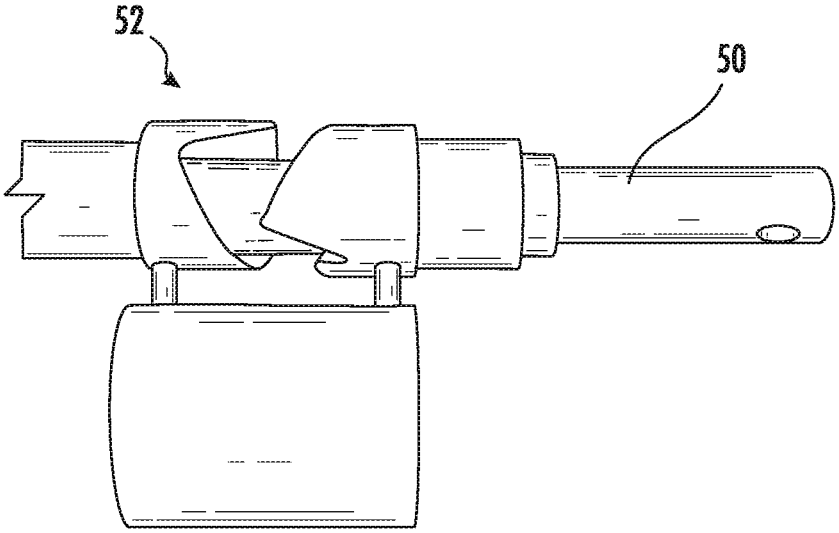
FIG. 8 is side view of an embodiment of the rotating shaft mechanism, including an embodiment of the upper and lower guide tracks and the slider.
Figure 9:
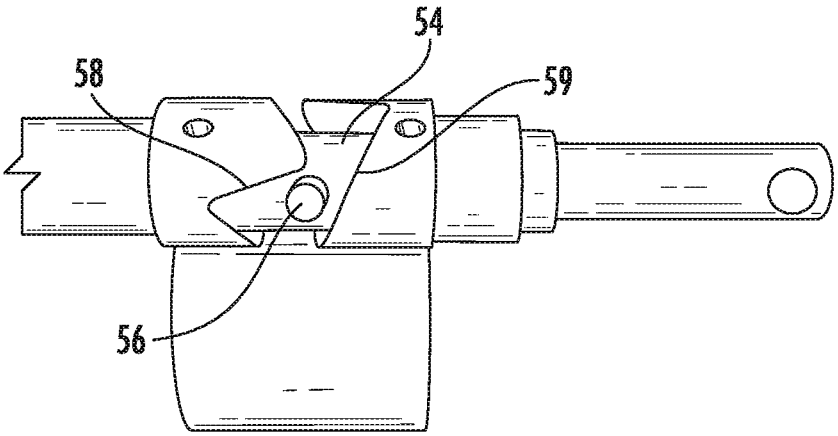
FIG. 9 is another side view of the rotating shaft mechanism of FIG. 8.
Figure 10:
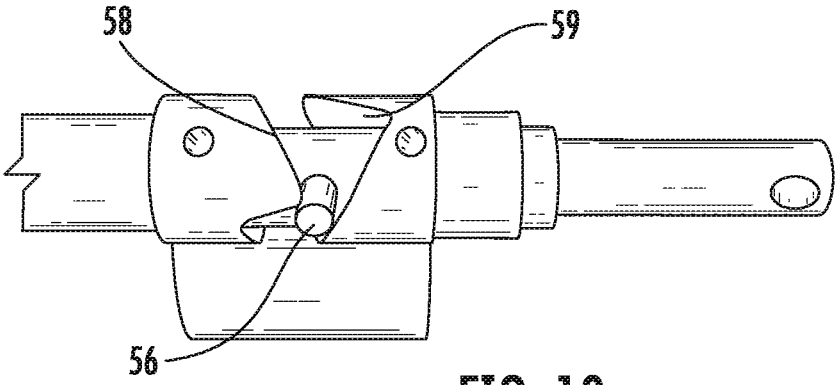
FIG. 10 is still another side view of the rotating shaft mechanism of FIG. 8.
Figure 12:
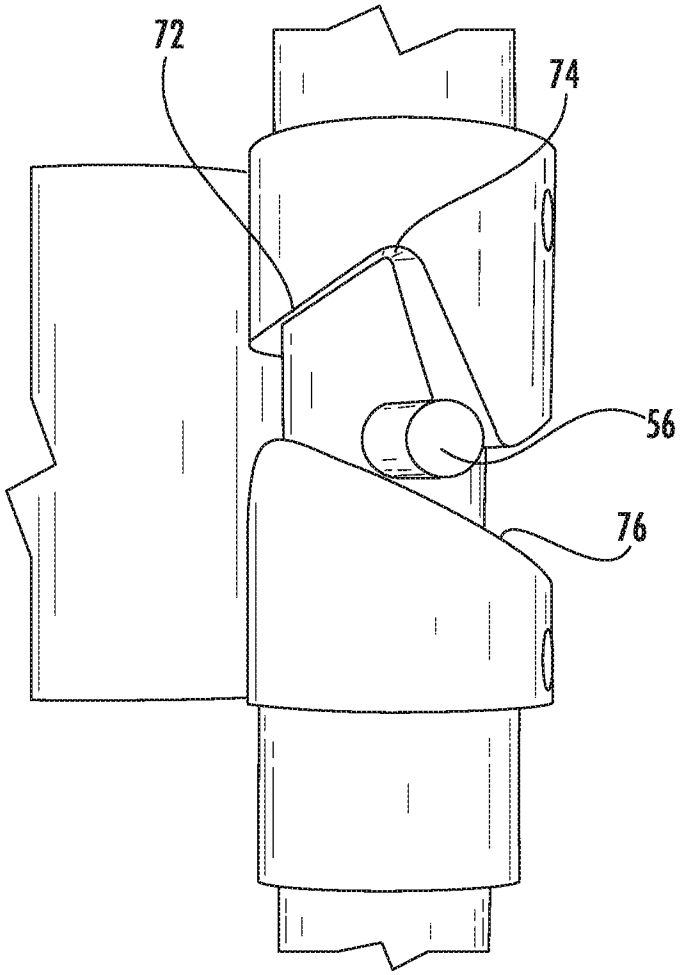
FIG. 12 is another close-up of the slider moving down the lower guide track of FIG. 8.
Figure 11:
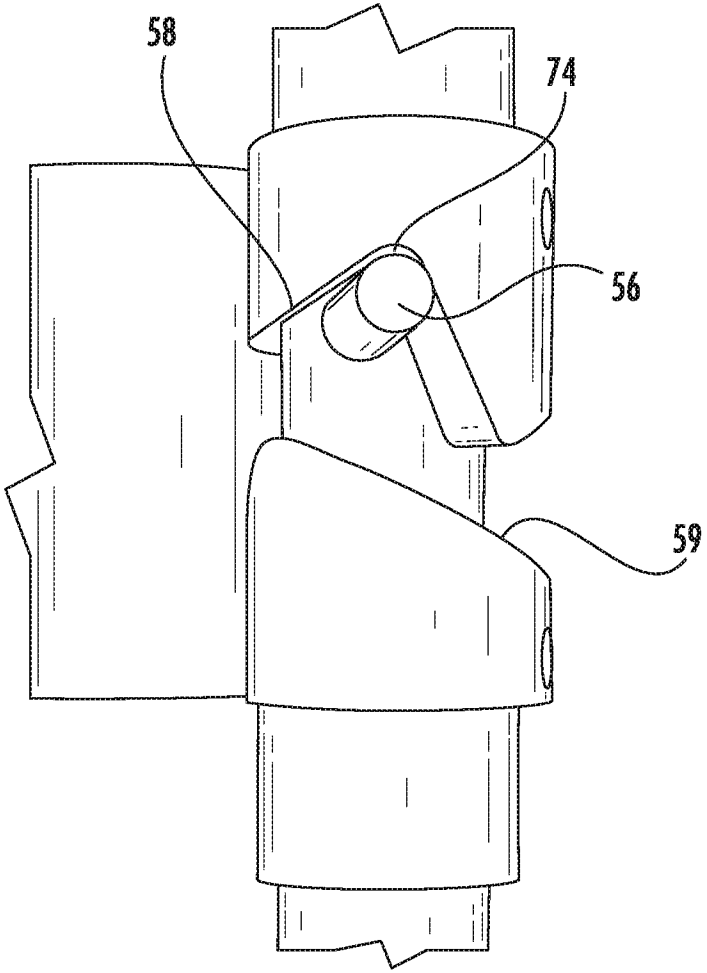
FIG. 11 is a close-up view of the slider at a peak of the upper guide track of FIG. 8.
Figure 13:
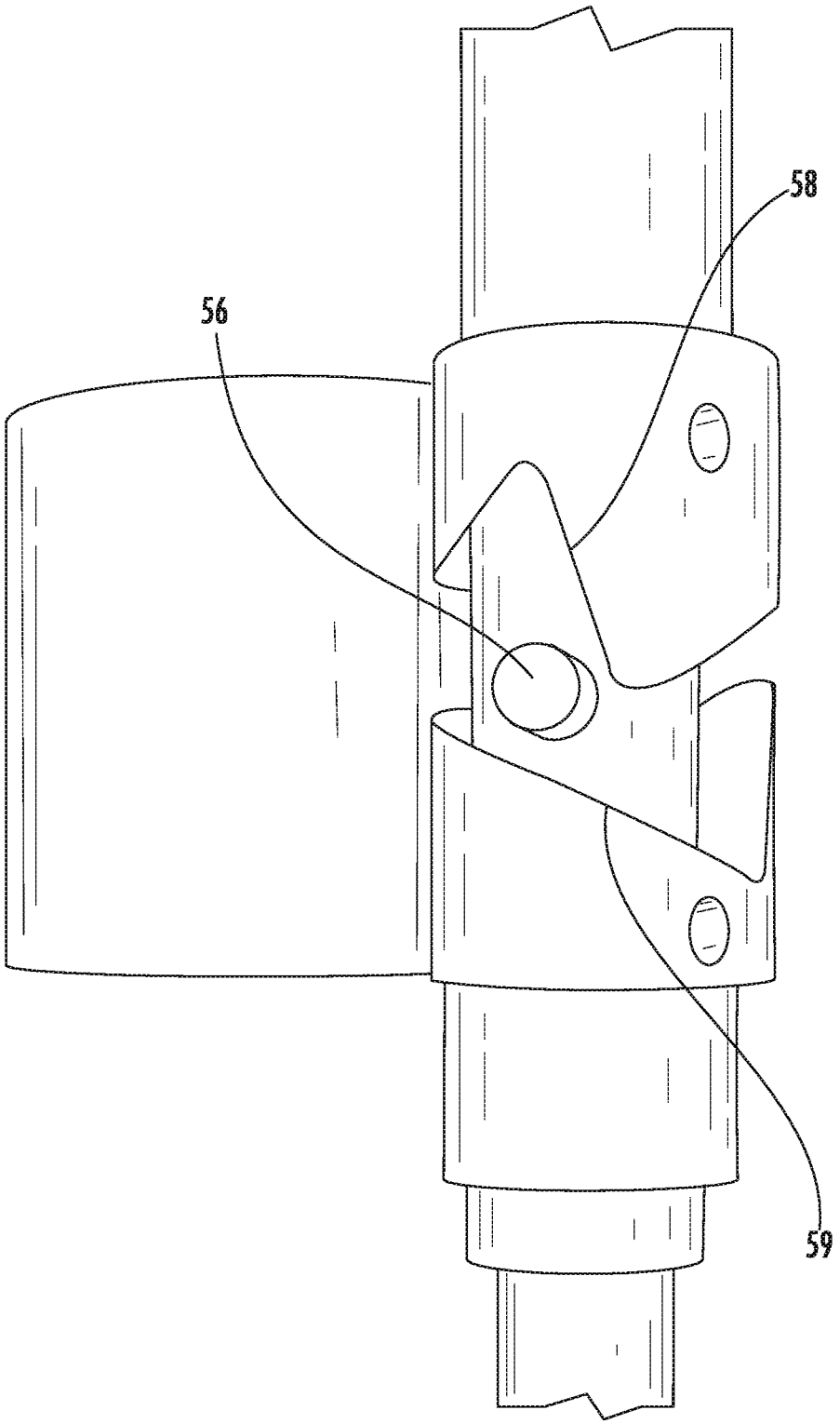
FIG. 13 is another close-up of the slider and guide tracks of FIG. 8.

Referring now to FIGS. 5-7, expansion and contraction of the lighting system 10 is explained. Beginning in the collapsed configuration (FIG. 3), the lighting system 10 can be more readily transported and stored. Once it is mounted to a proper structure, as discussed above, the lighting system 10 is ready for expansion. By firmly directing downward pressure on the top of traveler 16, the traveler 16 begins to move toward the latch plate 32. As a result, the inner rods 24 are forced into the outer tubes 26 of the guide rails 22 and the flexible ribs 20 begin to pivot at each of the pivoting attachment points 62 (FIG. 15) and bow outward. Continuing with the downward pressure, the key member 38 is shown to be aligned with the correspondingly shaped opening 34 of the latch plate 32. Shortly after the key member 38 enters the opening 34 it abuts a secondary plate 64. At this point, the operation of the rotating shaft mechanism 50 locks the traveler 16 by rotating the key member 38 to create a misalignment with the opening 34. This operation is described in greater detail below. Once locked in place, the portable light system 10 is ready for use.

Referring now to FIGS. 8-14, the rotating shaft mechanism 50 can be more readily understood. The mechanism 50 allows single-handed expansion of the portable light system 10 by applying a downward force to the traveler 16. The amount of force necessary will vary, but can be kept to a minimum with the use of proper materials and components, as will be understood by those skilled in the art.

The embodiment of the mechanism 50 shown comprises a cylinder 52 having one end fixed to the traveler 16, a rotatable shaft 54 positioned and movable within the cylinder 52, a slider 56 transversely fixed to the rotatable shaft 54, a first slider guide track 58 fixed to the cylinder 52 at a position to engage a first side of the slider 56, and a second slider guide track 59 fixed to the cylinder 52 at a position to engage a second side of the slider 56 opposite the first side. The rotatable shaft 54 is outwardly biased within the cylinder 52. The first and second slider guide tracks, 58 and 59, are concealed within a housing 70 to prevent dirt, dust, and other debris from interfering with operation of the mechanism 50.

Figure 14:
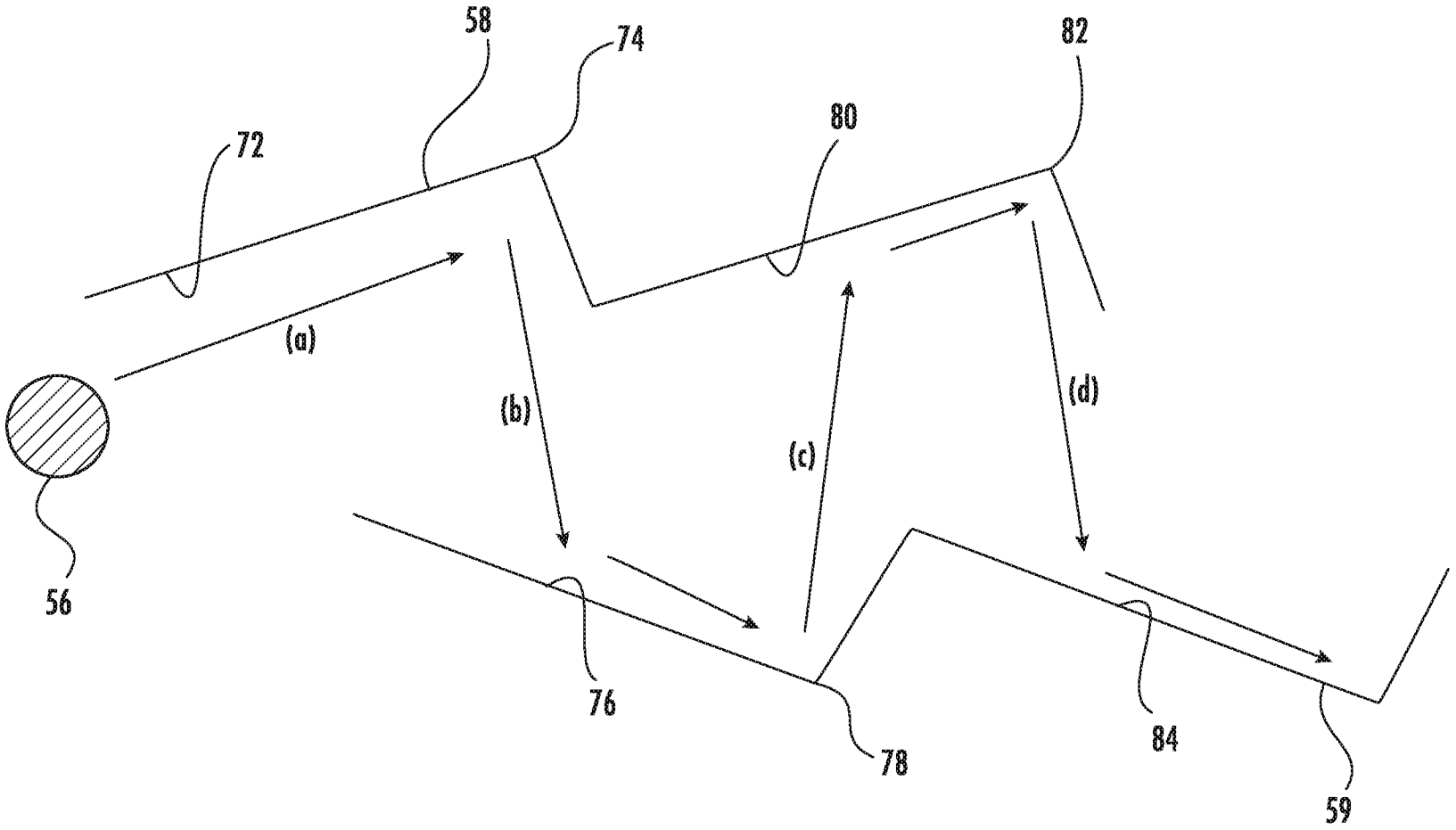
FIG. 14 is a schematic illustration of an embodiment of the upper and lower slider guide tracks.
Figure 15:
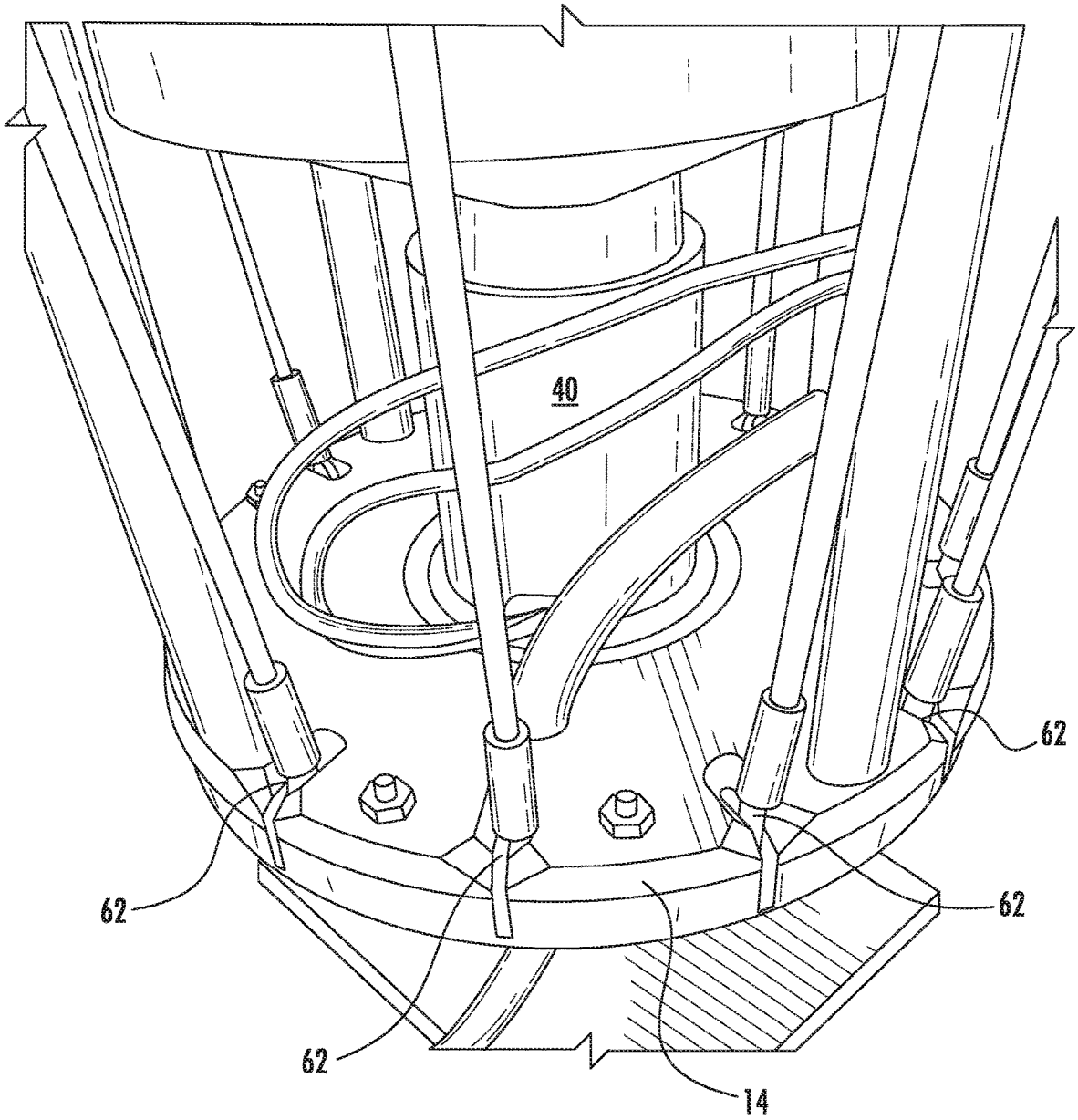
FIG. 15 is a close-up of an embodiment of the base of the disclosed lighting system.
Figure 16:
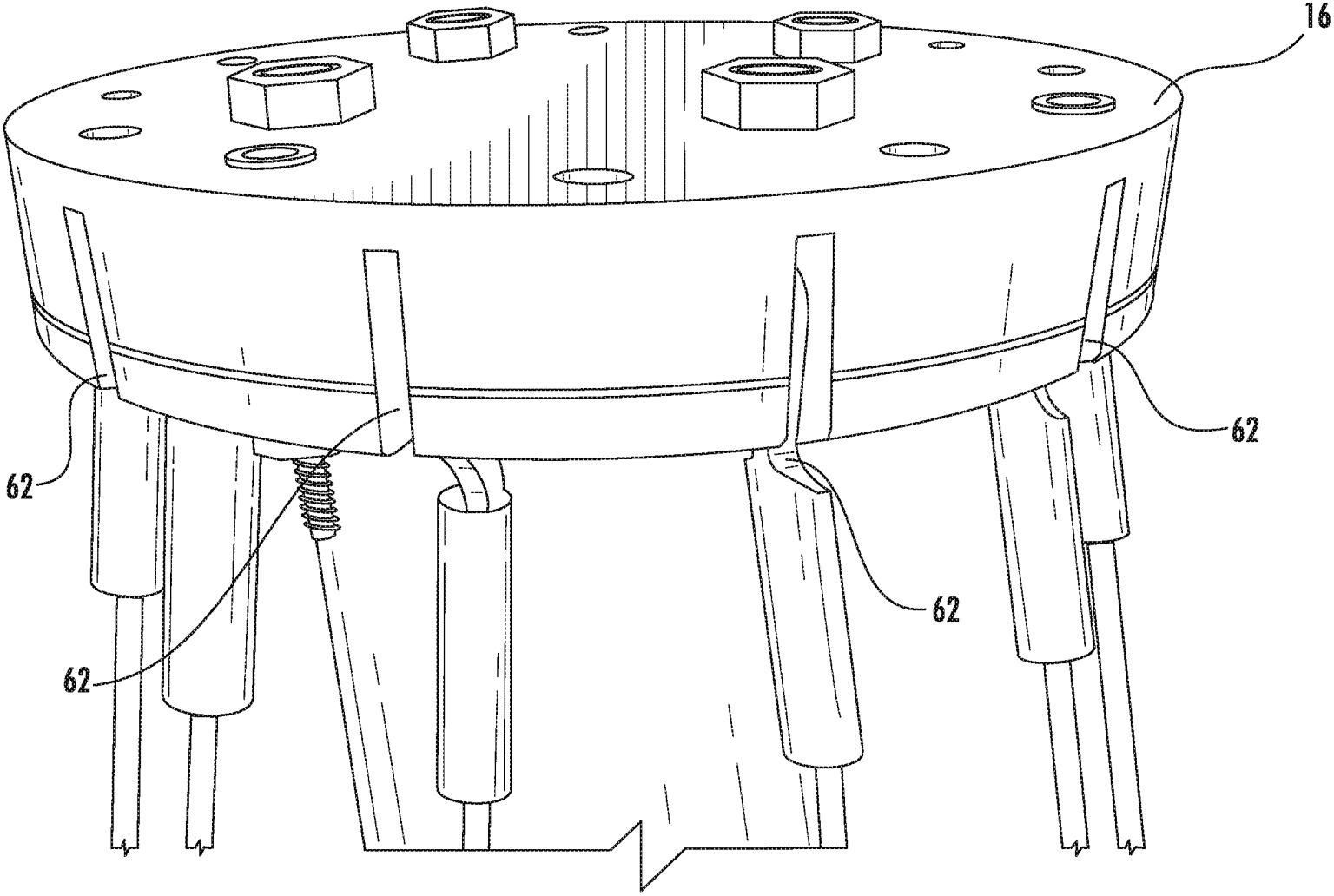
FIG. 16 is a close-up of an embodiment of the traveler, showing the upper surface and the attachment of frame members.

Returning to the above discussion on expansion of the lighting system 10, FIG. 14 provides a two-dimensional illustration of the movement of the slider 56 around the upper and lower guide tracks, 58 and 59, respectively. When the key member 38 passes through the opening 34 in the latch plate 32 (starting point for key member 38) and contacts the secondary plate 64, the rotatable shaft 54 is forced into the cylinder 52. As the shaft 54 moves into the cylinder 52, the slider 56 contacts an upwardly sloped surface 72 of the first guide track 58. As a result, the slider 56 follows the sloped surface 72 and moves (arrow (a) of FIG. 14) to a position about 90 degrees from the starting point, stopping when it reaches the apex 74 of the sloped surface 72. At this point, the key member 38, which is also moved the 90 degrees, is unaligned with the opening 34.

Next, by removing the downward pressure on the traveler 16, the flexible ribs 20 and the guide rails 22 exert an upward bias on the traveler 16. As the traveler 16 rises, the rotatable shaft 54 is biased back down from within the cylinder 52. The slider 56 contacts a sloped surface 76 of the second guide track 59 and is moved (arrows (b) of FIG. 14) another 90 degrees (i.e., now 180 degrees from the starting point) until it reaches the bottom 78 of the sloped surface 76. However, the now unaligned key member 38 catches on the latch plate 32 and prevents the traveler 16 from further upward movement. The lighting system 10 is now fully expanded and locked in place for use (see FIG. 1).

Preferably, the slider 56 moves 90 degrees each time the rotatable shaft 54 moves into and out of the cylinder 52. However, it is only required that with each combined inward and outward stroke (one cycle), the slider 56, and thus the key member 38, moves a total of 180 degrees. This guarantees that the slider 56 will return, 360 degrees, to the starting point after two cycles. Accordingly, the slider 56 may move anywhere in the range of from 10 to 170 degrees on the first rotation and then from 170 to 10 degrees on the second rotation—i.e., one cycle and 180 degrees. Those skilled in the art would understand that changing the length and slope of each of the slider guide tracks, 58 and 59, is all that is required to change the degrees of rotation.

When the portable lighting system 10 is ready to be removed, transported, stored or collapsed for any reason, a user only needs to press downward on the top of the traveler 16, as previously described. This will drive the rotatable shaft 54 and key member 38 into the secondary plate 64 forcing the shaft 54 into the cylinder 52. Again, the slider 56 contacts a second sloped surface 80 of the first guide track 58 and moves (arrows (c) of FIG. 14) the slider 56 another 90 degrees (now 270 degrees from the starting point) until an apex 82 is reached. As the force is removed, the rotatable shaft 54 is biased downward and the slider 56 contacts a second sloped surface 84 of the second guide track 59. The shaft 54 and key member 38 are moved (arrow (d) of FIG. 14) a final 90 degrees, which realigns the key member 38 with the opening 34. As a result, the traveler 16 is biased by the flexible ribs 20 and the guide rails 22 back to the configurations shown in FIG. 3.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A portable lighting system comprising:

a base for supporting the portable lighting system;

a light source positioned on the base;

a traveler having a key member attached to a rotating shaft mechanism extending from the traveler;

a frame connected to the base and the traveler and enclosing the light source, the frame comprising;

a plurality of flexible ribs attached to the base at a first end and to the traveler at a second end;

a latch plate having a key opening for engaging the key member and spaced a distance from the traveler; and at least one guide track connected between the traveler and the latch plate;

wherein the traveler is movable along the guide member from a starting position toward the latch plate causing the flexible ribs to bend outwardly and the key member is configured to enter the key opening and rotate via the rotating shaft mechanism to lock the traveler from returning to the starting position on the guide track.

2. The portable lighting system of claim 1, wherein the rotating shaft mechanism is configured to rotate the key member in the range of 10 to 170 degrees when the traveler reaches a first point along the guide track, then 170 to 10 degrees at a second point along the guide track.

3. The portable lighting system of claim 2, wherein the rotating shaft mechanism is configured to rotate the key member in the range of 60 to 120 degrees at the first point and 120 to 60 degrees at the second point.

4. The portable lighting system of claim 1, further comprising a cover attachable to the flexible ribs to enclose the light source.

5. The portable lighting system of claim 2, further comprising a cover attachable to the flexible ribs to enclose the light source.

6. The portable lighting system of claim 1, wherein the light source comprises an LED bulb having a watt equivalent in the range of 300 to 1500 watts.

7. The portable lighting system of claim 1, wherein the rotating shaft mechanism comprises a cylinder, a rotatable shaft movable within the cylinder in a longitudinal direction, a first 360-degree track fixed to the cylinder, a second 360-degree track fixed to the cylinder, and a slider transverse to the rotatable shaft and positioned to engage the first track with a first side and the second track with a second side.

8. The portable lighting system of claim 7, wherein the slider engages the first track when the rotatable shaft moves longitudinally in a first direction within the shaft and the slider engages the second track when the rotatable shaft moves longitudinally in a second direction within the shaft, the second direction being opposite the first direction.

9. The portable lighting system of claim 8, wherein the shaft rotates as it moves in the first and second directions as a result of the slider engaging the first and second tracks.

10. The portable lighting system of claim 1, further comprising a bracket attached to the base to mount to a vehicle.

11. The portable lighting system of claim 1, further comprising a bracket attached to the base to mount to a roadway stand.

12. The portable lighting system of claim 1, further comprising an AC power cord electrically connected to the light source.

* * * * *